US009150039B2

(12) United States Patent
Moriya

(10) Patent No.: US 9,150,039 B2
(45) **Date of Patent: *Oct. 6, 2015**

(54) IMAGE FORMING APPARATUS INCLUDING SKEW CORRECTION MECHANISM, CONTROL METHOD THEREFOR, AND STORAGE MEDIUM

(71) Applicant: CANON KABUSHIKI KAISHA, Tokyo (JP)

(72) Inventor: Masaaki Moriya, Moriya (JP)

(73) Assignee: CANON KABUSHIKI KAISHA (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/845,654

(22) Filed: Mar. 18, 2013

(65) Prior Publication Data

US 2013/0193638 A1 Aug. 1, 2013

Related U.S. Application Data

(63) Continuation of application No. 13/024,612, filed on Feb. 10, 2011, now Pat. No. 8,437,682.

(30) Foreign Application Priority Data

Feb. 15, 2010 (JP) ..... 2010-030480
Feb. 9, 2011 (JP) ..... 2011-025888

(51) Int. Cl.

| | |
|---|---|
| ***G03G 15/00*** | (2006.01) |
| ***B65H 9/00*** | (2006.01) |
| ***B41J 13/26*** | (2006.01) |
| ***B65H 7/08*** | (2006.01) |
| ***B65H 7/10*** | (2006.01) |

(52) U.S. Cl.

CPC . *B41J 13/26* (2013.01); *B65H 7/08* (2013.01); *B65H 7/10* (2013.01); *B65H 9/002* (2013.01); *G03G 15/6564* (2013.01); *G03G 15/6567* (2013.01); *B65H 2511/242* (2013.01); *B65H 2511/514* (2013.01); *B65H 2513/104* (2013.01); *B65H 2513/11* (2013.01); *B65H 2513/511* (2013.01); *B65H 2513/53* (2013.01); *B65H 2701/1111* (2013.01);

(Continued)

(58) Field of Classification Search

CPC ..... B65H 7/08; B65H 7/10; B65H 9/002; B41J 13/26; G03G 15/6558; G03G 2215/00561; G03G 15/6564; G03G 15/6567

USPC ..... 399/371, 372, 394, 395; 271/259, 228, 271/265.02, 265.03

See application file for complete search history.

(56) References Cited

U.S. PATENT DOCUMENTS 7,472,905 B2 * 1/2009 Inoue ..... 271/227
7,500,669 B2 3/2009 Mandel (Continued)

FOREIGN PATENT DOCUMENTS

JP 10-032682 A 2/1998
JP 2003-146485 A 5/2003

*Primary Examiner* — Matthew G Marini
*Assistant Examiner* — Justin Olamit
(74) *Attorney, Agent, or Firm* — Rossi, Kimms & McDowell LLP

(57) ABSTRACT

An image forming apparatus that can detect a leading edge of a tabbed sheet after skew correction with high accuracy and without increasing a size of the apparatus. A transfer unit transfers a toner image to the sheet, the skew of which having been corrected based on a detection result of a first skew detection unit, while the toner image is controlled to be synchronized with the sheet based on the detection result of the first skew detection unit and a detection result of a second skew detection unit.

45 Claims, 11 Drawing Sheets

(52) U.S. Cl.
CPC ..... *B65H 2701/1311* (2013.01); *B65H 2701/1315* (2013.01); *G03G 2215/00409* (2013.01); *G03G 2215/00561* (2013.01); *G03G 2215/00599* (2013.01); *G03G 2215/00603* (2013.01); *G03G 2215/00721* (2013.01); *G03G 2215/1666* (2013.01)

(56) References Cited

U.S. PATENT DOCUMENTS

| | | | | |
|---|---|---|---|---|
| 7,607,660 | B2 * | 10/2009 | Inoue | 271/228 |
| 2005/0158093 | A1 | 7/2005 | Kato et al. | |
| 2010/0196072 | A1 | 8/2010 | Hoover et al. | |

* cited by examiner

IMAGE FORMING APPARATUS INCLUDING SKEW CORRECTION MECHANISM, CONTROL METHOD THEREFOR, AND STORAGE MEDIUM

BACKGROUND OF THE INVENTION

1. Field of the Invention

The present invention relates to an image forming apparatus including a skew correction mechanism, a control method therefor, and a storage medium, and more particularly, to an image forming apparatus including a skew correction mechanism that corrects skew of a sheet including a tabbed sheet, a control method therefor, and a storage medium.

2. Description of the Related Art

Some conventional image forming apparatuses such as copiers, printers, or facsimile machines include a skew correction mechanism that corrects skew of a sheet so as to align a direction or a position of a sheet conveyed to an image forming unit.

A skew correction method of a sheet in an image forming apparatus includes a method of correcting skew by forming a loop in a sheet using a pair of registration rollers. However, in this skew correction method, temporarily stopping conveyance of the sheet requires time to convey the sheet to a transfer position. In order to reduce the time required for the conveyance, an active registration method has been proposed of using two sensors and two sets of skew correction rollers independently rotated to convey and rotate a sheet, thereby correcting skew (see Japanese Patent Laid-Open Patent Publication (Kokai) No. 10-032682).

In the active registration method, first, a leading edge of the sheet is detected based on detection signals from the two sensors provided on a conveying path of the sheet in a direction perpendicular to a conveying direction when the leading edge of the sheet crosses the sensors. Then, a skew amount of the sheet is detected based on a difference in generation timing of the detection signals from the two sensors. Then, rotational speeds of two drive motors that drive the two sets of skew correction rollers respectively lying on either side of the conveying path are controlled depending on the detected skew amount, and sheet conveying speeds of the two sets of skew correction rollers are changed depending on the skew amount of the sheet, thereby correcting skew of the sheet. Specifically, in skew correction by the active registration method, depending on the skew amount of the sheet, the rotational speed of one skew correction roller is set lower (skew speed reducing control) or higher (skew speed increasing control) than the rotational speed of the other skew correction roller to correct skew of the sheet.

In the skew correction by the active registration method, the skew correction is performed without stopping conveyance of sheets temporarily, and thus a sheet interval (an interval between a preceding sheet and a following sheet) can be shorter than by other methods. This can increase sheet conveying efficiency, and for example, increase a substantial image forming speed without increasing an image forming process speed of an image forming apparatus. Thus, the active registration method is adopted in an image forming apparatus as a skew correction method that contributes to increase a speed of an image forming operation.

In recent years, demands for image forming on sheets having various shapes have been increased, and it has been desired to pass sheets not always having a rectangular shape, particularly, tabbed sheets in an image forming apparatus. The tabbed sheet refers to a sheet having, on an end side, a tab in which an index or the like is written for classification. The tab provided at a sheet end is not provided in a fixed position but in various positions so that indexes such as letters or figures written in the tabs can be easily checked. Thus, for skew correction of tabbed sheets, a method has been proposed of obtaining position information of a tab, and depending on whether a sensor detects the tab, correcting information from the sensor by an amount of a tab width to perform skew correction (see Japanese Patent Laid-Open Patent Publication (Kokai) No. 2003-146485).

The sheet having been subjected to the skew correction is controlled in conveying speed by registration rollers so that a leading edge of the sheet reaches a toner image transfer position of an image forming unit at predetermined timing. Specifically, when the sensor placed on a downstream side of the registration rollers on a conveying path detects the leading edge of the sheet, the sensor outputs a detection signal to a control unit, the control unit controls a rotational speed of the registration rollers depending on the detection signal to synchronize the sheet with a toner image on a photoconductive drum. Thus, the toner image is formed in an appropriate position on the sheet.

In the image forming apparatus, in order to convey a tabbed sheet having a tab on a leading edge side in a sheet conveying direction to a toner image transfer position at appropriate timing, the leading edge of the tabbed sheet needs to be detected except the tab after skew correction of the tabbed sheet is completed. Thus, there is a method of placing a plurality of sensors in a direction perpendicular to a sheet conveying direction on a downstream side of a pair of skew correction rollers, and precisely detecting a sheet leading edge except a tab by a difference in detection timing of the sensors.

However, when skew correction is performed by the above conventional method, the sheet leading edge needs to be detected by the sensors after the skew correction of the sheet is completed. This increases a sheet conveying path, and increases a size of an apparatus.

SUMMARY OF THE INVENTION

The present invention provides an image forming apparatus that solves the above-described problems, a control method therefor, and a storage medium.

The present invention further provides an image forming apparatus that can detect a leading edge of a tabbed sheet after skew correction with high accuracy and without increasing a size of the apparatus, a control method therefor, and a storage medium.

In a first aspect of the present invention, there is provided an image forming apparatus comprising a conveying unit configured to convey a sheet, a first skew detection unit configured to detect a skew amount of a side edge of the sheet conveyed by the conveying unit and a skew direction thereof, a second skew detection unit configured to detect a skew amount of a leading edge of the sheet conveyed by the conveying unit and a skew direction thereof, a skew correction unit configured to correct skew of the sheet based on a detection result of the first skew detection unit, a transfer unit configured to transfer a toner image to the sheet the skew of which has been corrected, a control unit configured to to synchronize the toner image transferred by the transfer unit with the sheet based on the detection result of the first skew detection unit and a detection result of the second skew detection unit.

According to the present invention, a leading edge of a tabbed sheet in a skew state and in conveyance can be precisely detected with high accuracy and without increasing a size of the apparatus, and the sheet can be conveyed to a toner image transfer position at appropriate timing from an obtained detection result.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof. It should be noted that the relative arrangement of the components, the numerical expressions and numerical values set forth in these embodiments do not limit the scope of the present invention unless it is specifically stated otherwise.

Figure 1:
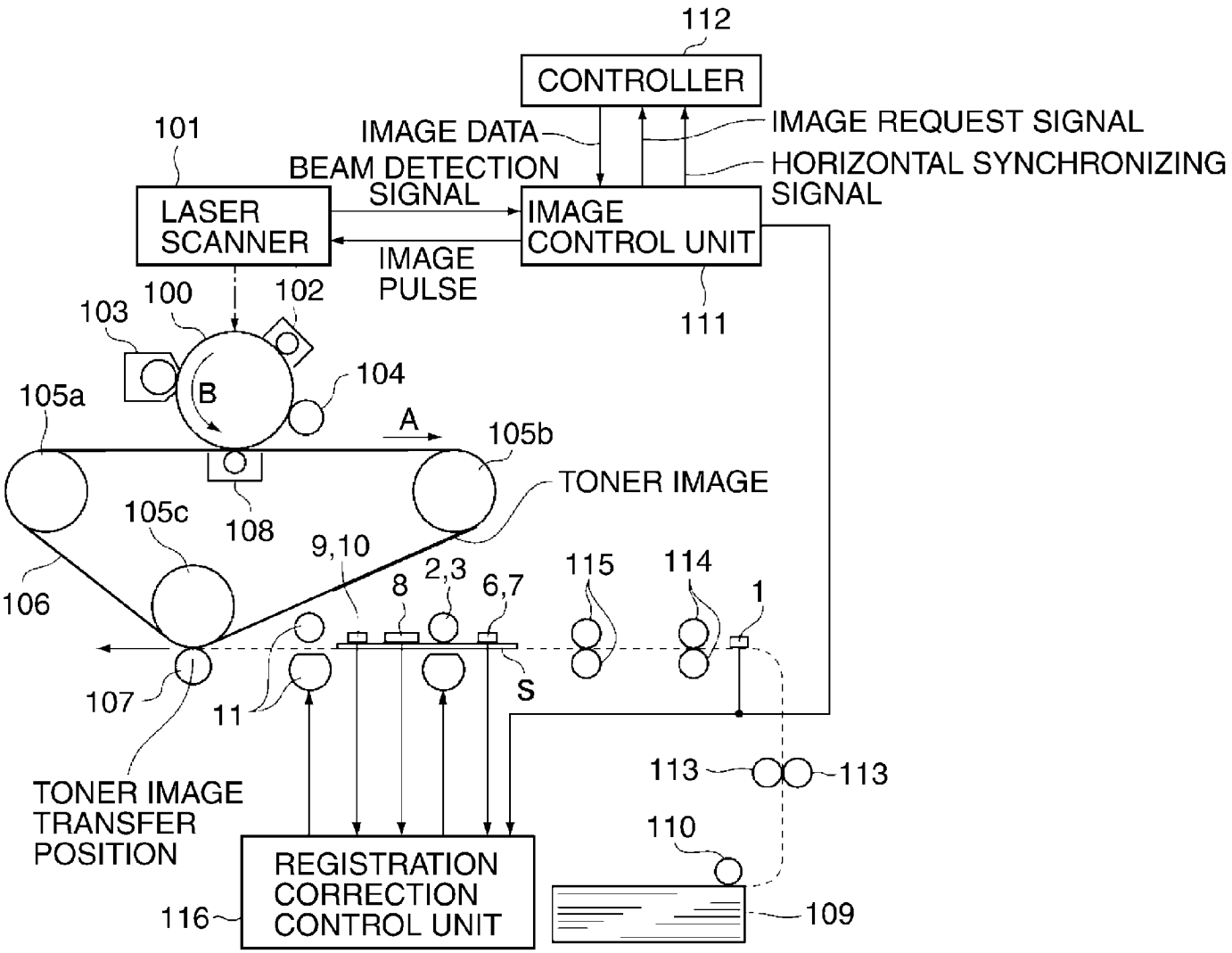
FIG. 1 is a view showing a schematic configuration of an image forming apparatus according to an embodiment of the present invention.

FIG. 1 is a view showing a schematic configuration of an image forming apparatus according to an embodiment of the present invention.

In FIG. 1, a laser scanner 101 applies a laser beam onto a photoconductive drum 100 based on image information to form an electrostatic latent image. The photoconductive drum 100 is an image carrier, and rotationally driven by a motor (not shown) in an arrow B direction (counterclockwise direction) in FIG. 1.

On an upstream side of a laser beam application position by the laser scanner 101 in a rotational direction of the photoconductive drum 100, a charger 102 for uniformly charging the photoconductive drum 100 is placed. On a downstream side of the laser beam application position, a developer 103 that develops the electrostatic latent image formed on the photoconductive drum 100 with toner to form a toner image, and a cleaner 104 are placed.

On a position opposed to the photoconductive drum 100 via an endless transfer belt 106, a primary transfer charger 108 for transferring the toner image from on the photoconductive drum 100 to the transfer belt 106 is placed to constitute a primary transfer unit.

The transfer belt 106 is wound around three rollers 105*a*, 105*b*, and 105*c*, the toner image formed on the photoconductive drum 100 is transferred to the transfer belt 106, then a secondary transfer unit consisting of the transfer belt 106 and a secondary transfer roller 107 transfers the toner image from the transfer belt 106 to a sheet S. In particular, a nip between the roller 105*c* and the secondary transfer roller 107 in the secondary transfer unit is a toner image transfer position where the toner image on the transfer belt 106 is transferred to the sheet S.

A cassette 109 houses sheets S such as recording sheets or OHP sheets, and the sheets S are fed from the cassette 109 by a sheet feed roller 110. A pair of rollers 113 receive a sheet S fed from the sheet feed roller 110 and feed the sheets S to two pairs of conveying rollers 114 and 115 downstream of an image forming reference sensor 1. The sheet S fed from the pair of the conveying roller 115 is received by paired two skew correction rollers 2 and 3.

The image forming reference sensor 1 detects a leading edge of the conveyed sheet S, and outputs a signal as a reference for transfer timing of a toner image in the secondary transfer unit to a registration correction control unit 116 and an image control unit 111.

A pair of sensors 6 and 7 are placed in a direction perpendicular to a conveying direction of the sheet S, and detect the leading edge of the sheet S conveyed on a sheet conveying path and output detection signals to the registration correction control unit 116.

A line sensor 8 detects a side edge position of the sheet S (side edge of the sheet), performs a plurality of detections at predetermined timing described later, and outputs each detection signal thereof to the registration correction control unit 116.

A pair of sensors 9 and 10 are placed in the direction perpendicular to the conveying direction of the sheet S. The sensors 9 and 10 are placed on the sheet conveying path between the line sensor 8 and a registration roller pair 11. When detecting the leading edge of the sheet S, the sensors 9 and 10 output detection signals to the registration correction control unit 116.

The sheet S fed from the paired two skew correction rollers 2 and 3 is received by the registration roller pair 11. The sheet S fed from the registration roller pair 11 is conveyed to the toner image transfer position in the secondary transfer unit.

The registration correction control unit 116 performs drive control of the skew correction rollers 2 and 3 and the registration roller pair 11. The image control unit 111 receives a beam detection signal for each scan line from the laser scanner 101, and synchronously therewith, transmits an image pulse according to image data to the laser scanner 101. The beam detection signal is generated when a beam detection sensor (not shown) detects a laser beam that is reflected by a polygon mirror that is included in the laser scanner 101 and deflects a laser beam.

A controller 112 temporarily stores image data transmitted from a PC, a leader, or the like (not shown), and transmits the image data to the image control unit 111 based on an image request signal and a horizontal synchronizing signal from the image control unit 111. It should be noted that the horizontal synchronizing signal is generated based on a beam detection signal output by the beam detection sensor included in the laser scanner 101. Then, after a predetermined number of horizontal synchronizing signals are counted with reference to the image request signal, the controller 112 synchronizes the image data with the horizontal synchronizing signal, and transmits the image data to the image control unit 111 every predetermined number of lines. The image data is converted by the image control unit 111 into an image pulse having a pulse width according to a density level presented by the data.

Next, an image forming operation in the image forming apparatus in FIG. 1 will be described.

When the sheet S is fed from the cassette 109, and the image forming reference sensor 1 detects the leading edge of the sheet S, the image forming reference sensor 1 outputs a detection signal. When receiving the detection signal, the image control unit 111 outputs the image request signal to the controller 112. By the image request signal, the controller 112 synchronizes image data with the horizontal synchronizing signal and transmits the image data to the image control unit 111. Then, the image control unit 111 transmits the image pulse according to the image data to the laser scanner 101.

Then, the laser scanner 101 applies a laser beam corresponding to the received image pulse, or a laser beam modulated based on image data corresponding to data from an image memory (not shown) onto the photoconductive drum 100 rotated in the arrow B direction in FIG. 1. At this time, the photoconductive drum 100 is previously charged by the charger 102, the laser beam is applied from the laser scanner 101 to form an electrostatic latent image, then the electrostatic latent image is developed by the developer 103, and a toner image is formed. Then, the toner image formed on the photoconductive drum 100 is transferred by the primary transfer unit onto the transfer belt 106 by action of a primary transfer bias voltage applied to the primary transfer charger 108. The transfer belt 106 onto which the toner image has been transferred is moved in an arrow A direction in FIG. 1, and the toner image is transferred to the sheet S at the toner image transfer position. The sheet S passes through the two pairs of the conveying rollers 114 and 115 and is subjected to skew correction by the paired two skew correction rollers 2 and 3. Then, the sheet is conveyed to the toner image transfer position by rotational driving of the registration roller pair 11 at timing when the toner image on the transfer belt 106 passes through the toner image transfer position.

Next, outlines of the registration correction control unit 116 and a registration correction mechanism will be described with reference to FIGS. 1 and 2.

Figure 2:
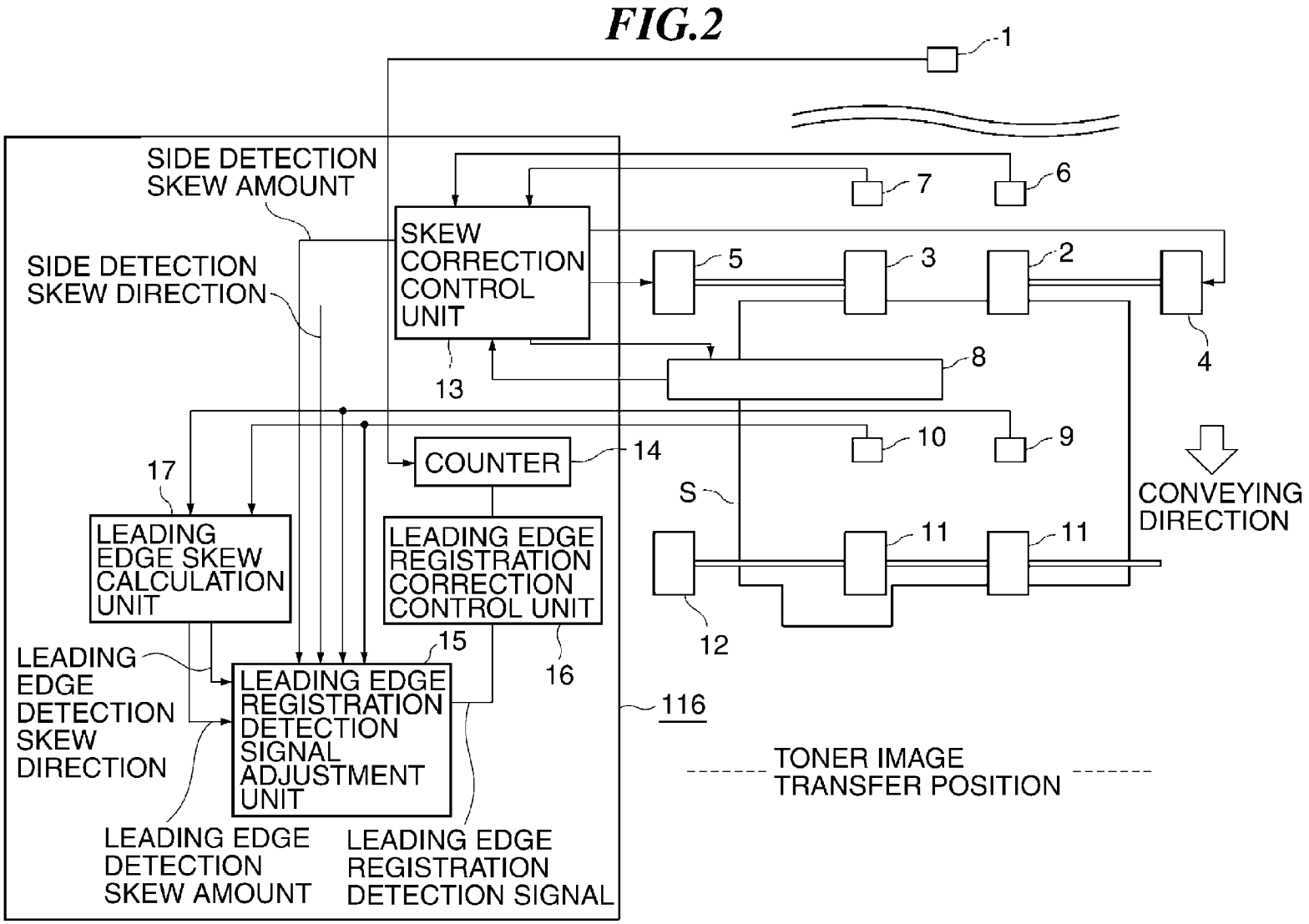
FIG. 2 is a view showing a schematic configuration of a registration correction control unit and a registration correction mechanism.

FIG. 2 is a view showing a schematic configuration of the registration correction control unit 116 and the registration correction mechanism. It should be noted that FIG. 2 shows contents of the registration correction control unit 116 as blocks for respective functions, but the blocks may be replaced by one CPU so that the CPU implements all operations therefor. The sheet S is a tabbed sheet in the shown example, but includes a rectangular sheet without a tab otherwise not specified thereafter.

In FIG. 2, the image forming reference sensor 1 is placed on the sheet conveying path, and outputs the detection signal to a counter 14 when detecting the leading edge of the sheet S conveyed from upstream of the conveying path. The counter 14 regards the detection signal from the image forming reference sensor 1 as a start trigger of the counter to start counting time. When counting a predetermined time, the counter 14 outputs a delay trigger signal for the detection signal from the image forming reference sensor 1 to the leading edge registration correction control unit 16.

The paired two skew correction rollers 2 and 3 are placed along a direction perpendicular to the conveying direction of the sheet S to correct skew of the sheet S, and are independently driven. As shown in FIG. 1, these rollers 2 and 3 are in pair and hold the sheet S, and one of the rollers 2 and 3 on a drive side is partly cut. In FIG. 1, the lower roller of the rollers 2 and 3 is a drive roller, and the upper roller thereof is a driven roller. In a sheet waiting state, the drive roller is stopped with the cut part being opposed to the conveying path, and the paired two rollers 2 and 3 are spaced apart from each other.

In this embodiment, the roller on a sheet corner side preceding by skew between the paired two skew correction rollers 2 and 3 is reduced in rotational speed from a specified speed to perform skew correction of the sheet S.

Motors 4 and 5 drive the skew correction rollers 2 and 3. The sensors 6 and 7 are placed along the direction perpendicular to the conveying direction upstream of the skew correction rollers 2 and 3. When detecting the leading edge of the sheet S, the sensors 6 and 7 output detection signals as triggers for controlling driving timing of the skew correction rollers 2 and 3 to a skew correction control unit 13.

The line sensor 8 detects a side edge of the sheet S, and outputs a distance from a reference position parallel to the sheet conveying direction to the side edge of the sheet S as edge position information to the skew correction control unit 13. It should be noted that detection of a skew amount of the sheet S requires edge position information at two spots on the side edge of the sheet S. Thus, the line sensor 8 receives two sampling instructions for the same sheet S from the skew correction control unit 13 at a predetermined time interval.

The sensors 9 and 10 are placed at a certain interval along the direction perpendicular to the conveying direction of the sheet S, and detect the leading edge of the sheet S that has not been subjected to skew correction.

The registration roller pair 11 is controlled to be increased or reduced in speed so that the leading edge of the sheet S reaches the toner image transfer position at predetermined timing. Two rollers consisting of the registration roller pair 11 have the same structure as the skew correction rollers 2 and 3. A motor 12 drives the registration roller pair 11. The motor 12 is controlled in driving by the leading edge registration correction control unit 16.

The skew correction control unit 13 controls driving of the skew correction rollers 2 and 3. Specifically, the skew correction control unit 13 receives the detection signals from the sensors 6 and 7, and after a lapse of a predetermined time, starts transmitting control pulse signals to the motors 4 and 5. For example, when the sensor 6 detects the leading edge of the sheet S, after a lapse of a predetermined time, the skew correction roller 2 starts rotation, and when the sensor 7 detects the leading edge of the sheet S, after a lapse of a predetermined time, the skew correction roller 3 starts rotation.

The skew correction control unit 13 also calculates a skew amount (side detection skew amount) and a skew direction (side detection skew direction) of the side edge of the sheet S from a difference between two pieces of edge position information received from the line sensor 8. Then, the skew correction control unit 13 controls driving of the motors 4 and 5 based on the skew amount and the skew direction and controls speed reduction of either of the skew correction rollers 2 and 3. Further, the skew correction control unit 13 outputs skew information (first skew information) including the calculated side detection skew amount and skew direction of the sheet S to a leading edge registration detection signal adjustment unit 15.

The leading edge registration detection signal adjustment unit 15 outputs a leading edge registration detection signal (control signal) of the sheet S to the leading edge registration correction control unit 16 based on detection signals from the sensors 9 and 10, and the skew information including the side detection skew amount and skew direction from the skew correction control unit 13.

The leading edge registration correction control unit 16 uses a later detection signal between the detection signals received from the sensors 9 and 10 as a reference signal, and transmits a rotational driving pulse of the registration roller pair 11 to the motor 12 after a predetermined time of the detection. The leading edge registration correction control unit 16 also calculates a leading edge registration correction amount from a difference between a time when receiving the delay trigger signal from the counter 14 and a time when receiving the leading edge registration detection signal from the leading edge registration detection signal adjustment unit 15. The leading edge registration correction control unit 16 transmits a rotational driving pulse for increasing and reducing a rotational speed of the registration roller pair 11 based on the leading edge registration correction amount to the motor 12.

Next, a flow of the skew correction of the sheet S will be described with reference to FIGS. 3 to 6. It should be noted that components other than the rollers and detection members are omitted in the shown example. The sheet S has already passed through the image forming reference sensor 1, and counting by the counter 14 has been started.

Figure 3A:
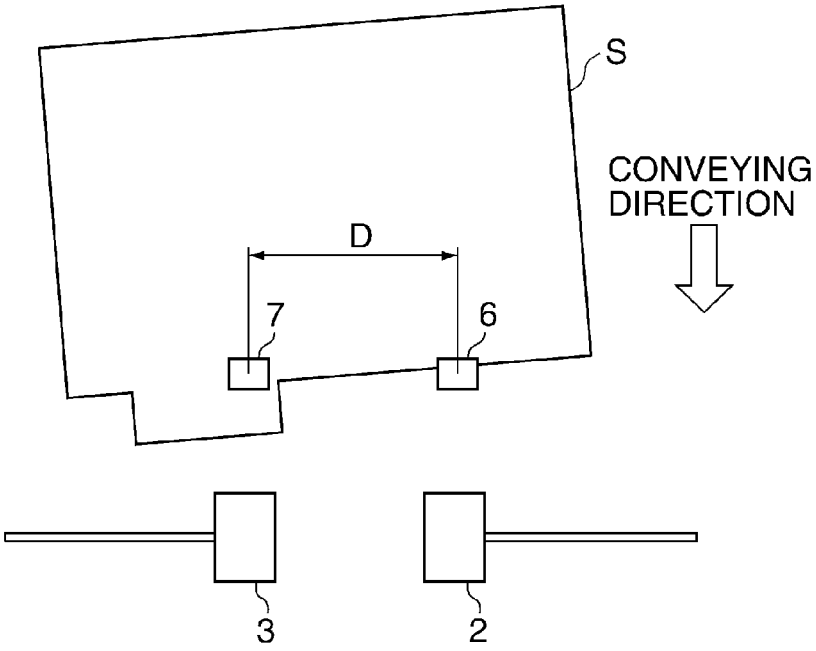
FIG. 3A is a view showing a state where both of two sensors detect a sheet S.

FIG. 3A is a view showing a state where both of the two sensors 6 and 7 detect the sheet S. The sensor 7 detects the sheet S earlier than the sensor 6. Thus, the skew correction roller 3 starts rotation earlier than the skew correction roller 2. Thus, when the leading edge of the sheet S reaches a roller nip, each roller reaches a specified conveying speed of the sheet S from a starting speed, and performs stable conveyance. It should be noted that rotation of the skew correction rollers 2 and 3 may be simultaneously started in response to the sensor 7 detecting the sheet S.

Figure 3B:
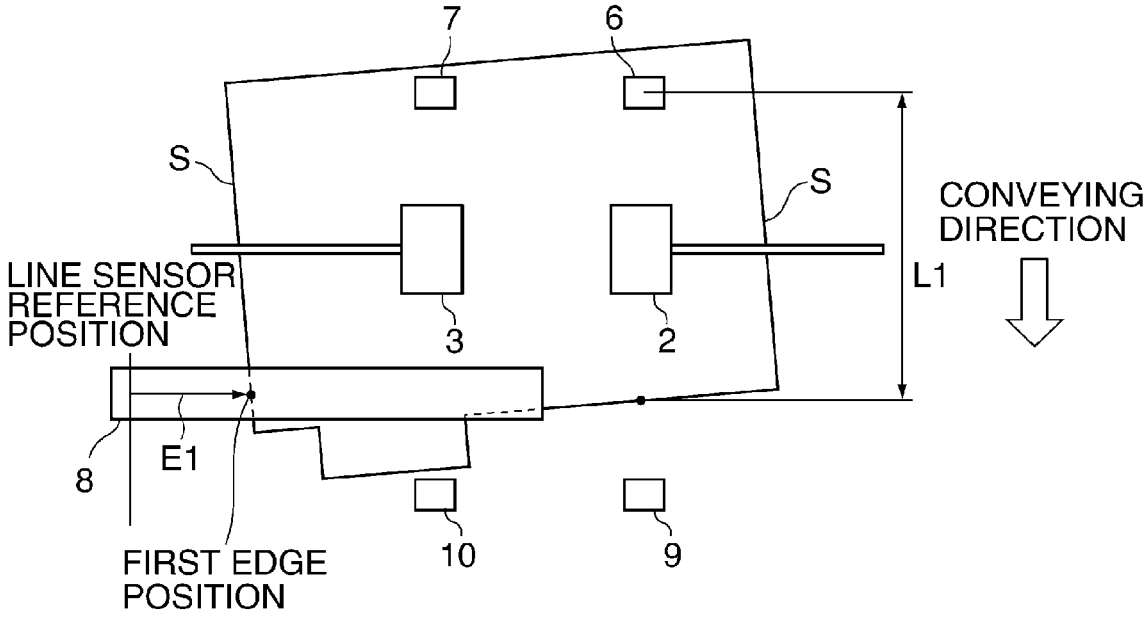
FIG. 3B is a view showing a state where a leading edge on a delay side of the sheet S detected by one of the sensors reaches a position a distance L1 away from the sensor.

Next, FIG. 3B is a view showing a state where a leading edge on a delay side of the sheet S detected by the sensor 6 reaches a position a distance L1 away from the sensor 6. Since the side edge of the sheet S is in a position readable by the line sensor 8 at this time, the line sensor 8 detects a first edge position.

Figure 4A:
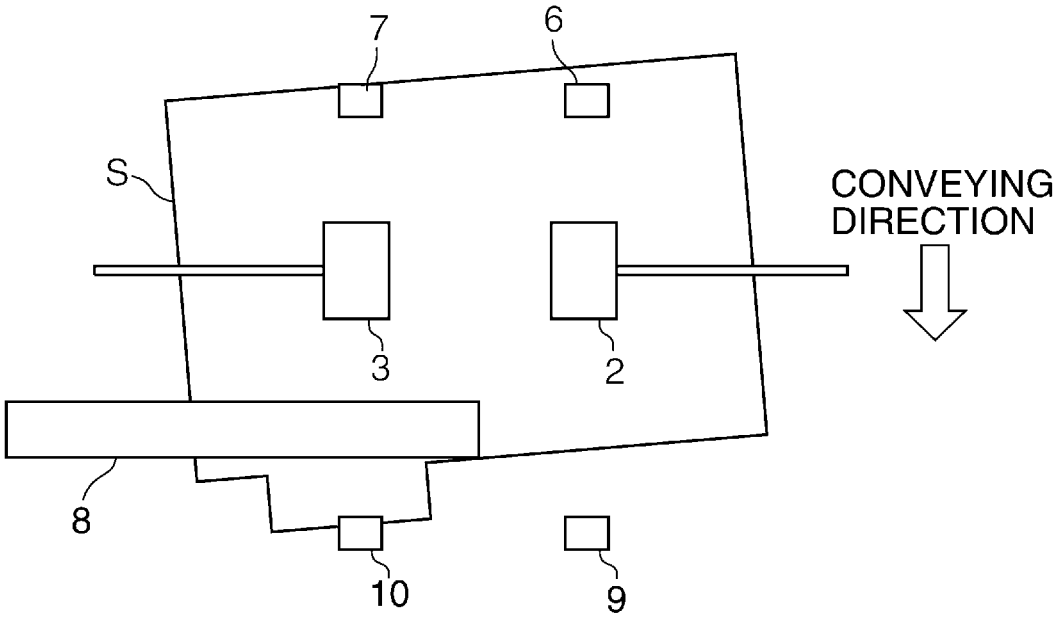
FIG. 4A is a view showing a state where one of the other two sensors detects a leading edge of the sheet S.

Next, FIG. 4A is a view showing a state where the sensor 10 detects the leading edge of the sheet S. When the sensor 10 detects the sheet S, the sensor 10 outputs a detection signal to a leading edge skew calculation unit 17 and the leading edge registration detection signal adjustment unit 15. The leading edge skew calculation unit 17 starts counting at timing when receiving the detection signal from the sensor 10. On the other hand, the leading edge registration detection signal adjustment unit 15 identifies the detection signal from the sensor 10 as a preceding detection signal. It should be noted that when the sensor 9 detects the leading edge of the sheet S earlier than the sensor 10, a detection signal from the sensor 9 is the preceding detection signal.

Figure 4B:
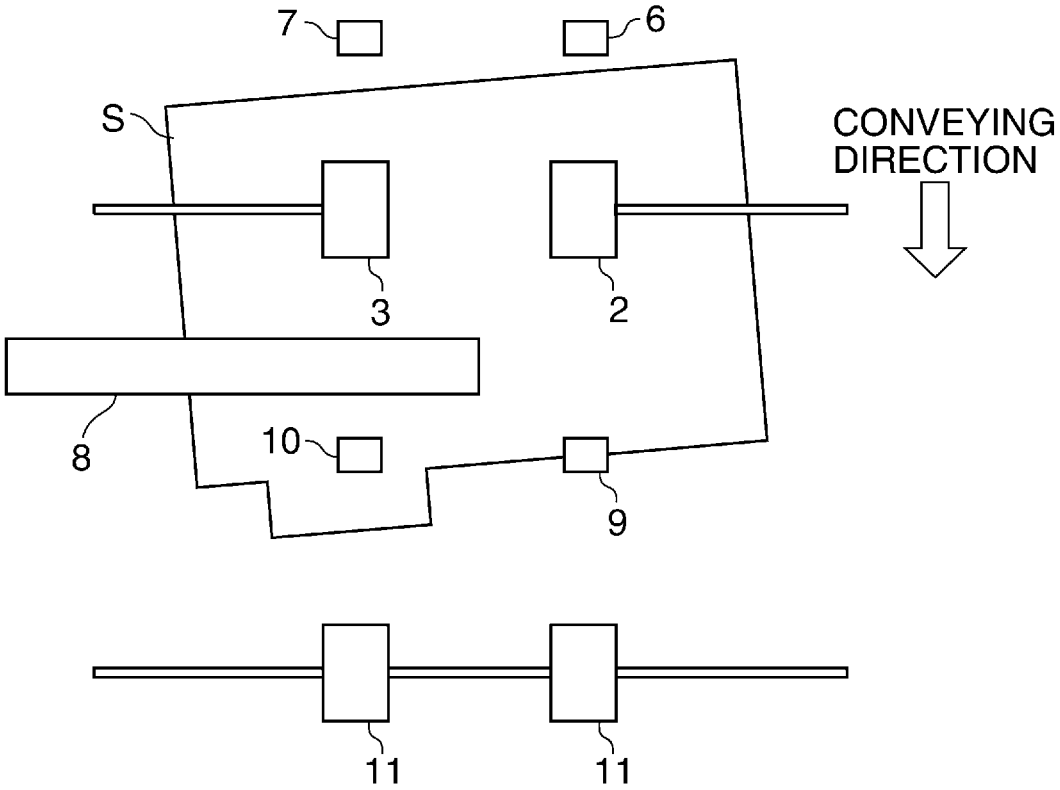
FIG. 4B is a view showing a state where the other one of the other two sensor detects the leading edge of the sheet S.

Next, FIG. 4B is a view showing a state where the sensor 9 detects the leading edge of the sheet S. When the sensor 9 detects the sheet S, the sensor 9 outputs a detection signal to the leading edge skew calculation unit 17 and the leading edge registration detection signal adjustment unit 15. The leading edge skew calculation unit 17 stops counting at timing when receiving the detection signal from the sensor 9, converts a counted time into a distance, and outputs the distance to the leading edge registration detection signal adjustment unit 15 as a skew amount (leading edge detection skew amount: Ahead_Skew) of the leading edge of the sheet S. The leading edge skew calculation unit 17 determines a skew direction of the leading edge in accordance with which of the sensors 9 and 10 firstly detecting the leading edge of the sheet S, and outputs a skew direction (leading edge detection skew direction) of the leading edge of the sheet S to the leading edge registration detection signal adjustment unit 15.

On the other hand, the leading edge registration detection signal adjustment unit 15 identifies the detection signal from the sensor 9 as a following detection signal, and receives skew information (second skew information) including a leading edge detection skew amount and a skew direction from the leading edge skew calculation unit 17. It should be noted that when the sensor 10 detects the leading edge of the sheet S later than the sensor 9, the detection signal from the sensor 10 is the following detection signal.

The registration roller pair 11 starts rotational driving after a lapse of a predetermined time from the timing in FIG. 4B.

In the state of the sheet S in the shown example, the sensor 9 can detect the leading edge on the delay side of the sheet S accurately, thus the detection signal of the sensor 9 can be used without change as the leading edge registration detection signal. However, depending on a tab position and a skew state of the sheet S, the detection signals of the sensors 9 and 10 need to be subjected to delay adjustment to output as leading edge registration detection signals as described later.

The leading edge registration correction control unit 16 compares receiving timing of the delay trigger signal received from the counter 14 and receiving timing of the leading edge registration detection signal received from the leading edge registration detection signal adjustment unit 15. When the leading edge registration detection signal is earlier than the delay trigger signal, the leading edge registration correction control unit 16 calculates a pulse period corresponding to a proper variable speed so as to reduce the speed of the registration roller pair 11 in leading edge registration correction. When the leading edge registration detection signal is later than the delay trigger signal, the leading edge registration correction control unit 16 calculates a pulse period corresponding to the proper variable speed so as to increase the speed of the registration roller pair 11 in leading edge registration correction.

Figure 5A:
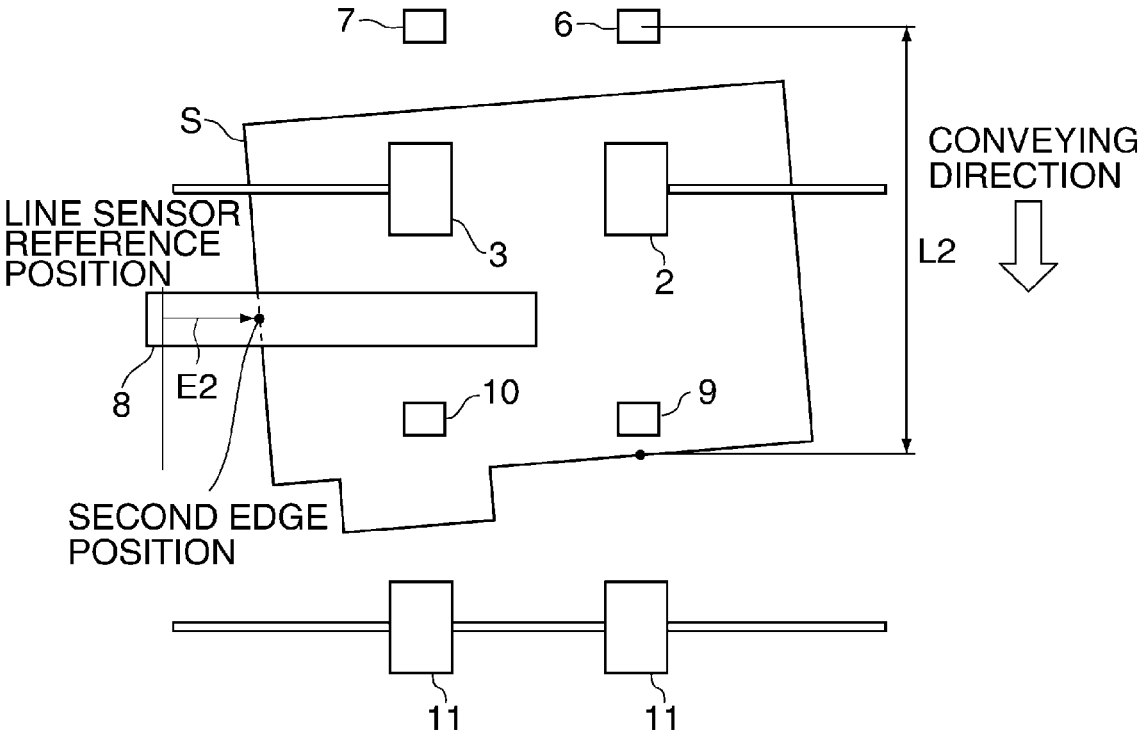
FIG. 5A is a view showing a state where the leading edge on the delay side of the sheet S detected by one of the sensors reaches a position a distance L2 away from the sensor.

Next, FIG. 5A is a view showing a state where the leading edge on the delay side of the sheet S detected by the sensor 6 reaches a position a distance L2 away from the sensor 6. At this time, the line sensor 8 detects a second edge position. The skew correction control unit 13 calculates a skew amount for a distance D between the sensors 6 and 7 from the detected first edge position and second edge position. When a distance between a line sensor reference position and the first edge position is E1, and a distance between the line sensor reference position and the second edge position is E2, a side detection skew amount: Side_Skew is $(E2-E1)\times(D/(L2-L1))$. In the case of FIG. 5A, $E1>E2$ and a value of the side detection skew amount is minus. In this state, a sheet corner on a side of the skew correction roller 3 precedes a sheet corner on a side of the skew correction roller 2. From this result, the skew correction control unit 13 calculates a speed reduction pulse period so that a conveying amount by the skew correction roller 3 is smaller than a conveying amount by the skew correction roller 2 by the skew amount, and outputs the pulse to the motor 5.

Figure 5B:
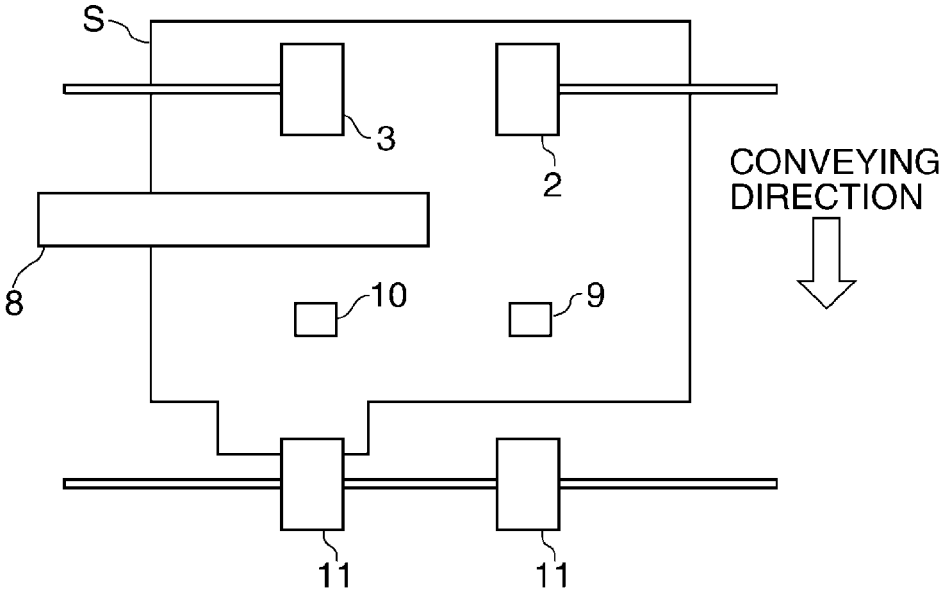
FIG. 5B is a view showing a state where skew correction of the sheet S is completed.
Figure 6:
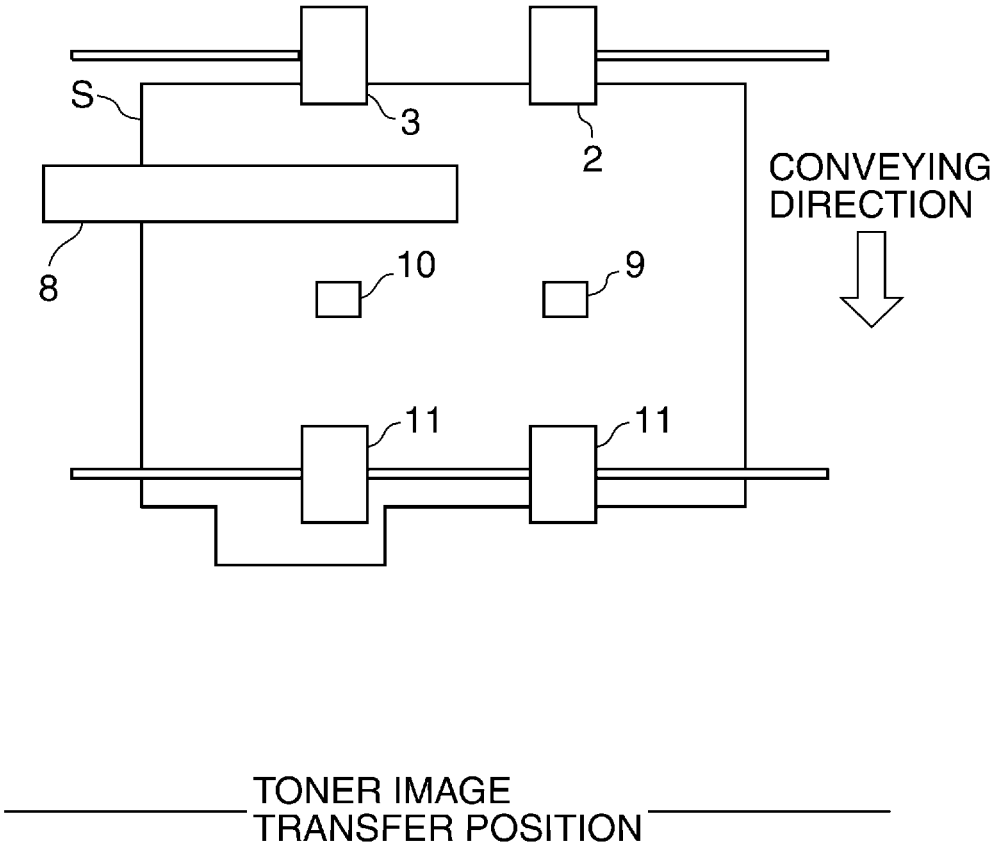
FIG. 6 is a view showing a state where the sheet S is held by a nip of a registration roller pair.

Next, FIG. 5B is a view showing a state where skew correction of the sheet S is completed. In the shown example, the skew correction is completed before a tab leading edge reaches a nip of the registration roller pair 11. The shown example is a view showing a state where leading edge registration correction by the registration roller pair 11 is started. FIG. 6 is a view showing a state where the sheet S is held by the nip of the registration roller pair 11.

As described above, the leading edge registration correction is completed before the leading edge of the sheet S reaches the toner image transfer position.

Next, a method of adjusting the leading edge registration detection signal output from the leading edge registration detection signal adjustment unit 15 to the leading edge registration correction control unit 16 will be described with reference to FIGS. 7 to 9.

Figure 8A:
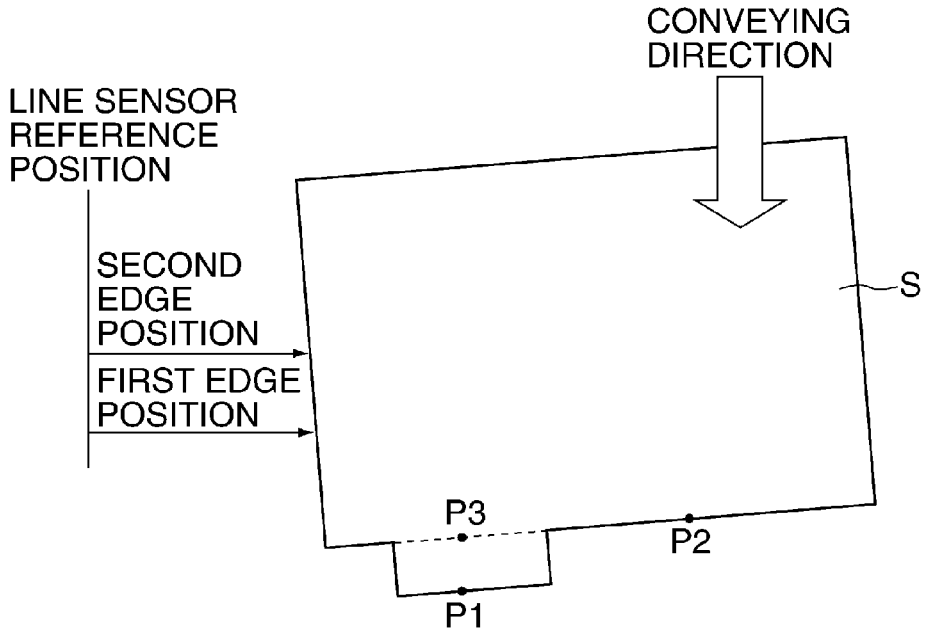
FIG. 8A is a view showing a state where the tabbed sheet is skewed so that a side thereof without a tab is delayed.

In this embodiment, the skew correction is speed reducing correction, and regardless of whether there is a tab at the leading edge of the sheet S or not, control is performed so that a leading edge on an advanced side is aligned with a leading edge on a delay side when the sheet S is taken as a rectangular sheet. Thus, the leading edge registration detection signal adjustment unit 15 wants, as leading edge registration position information of the sheet S, the leading edge on the delay side when the sheet S is taken as a rectangular sheet. When the sheet S is skewed so that a side without a tab is delayed as shown in FIG. 8A, a leading edge P2 detected by the sensor 9 is the leading edge on the delay side as when the sheet S is taken as a rectangular sheet. In this case, detection information detected by the sensors 9 and 10 can be used as the leading edge registration position information without change.

Figure 7A:
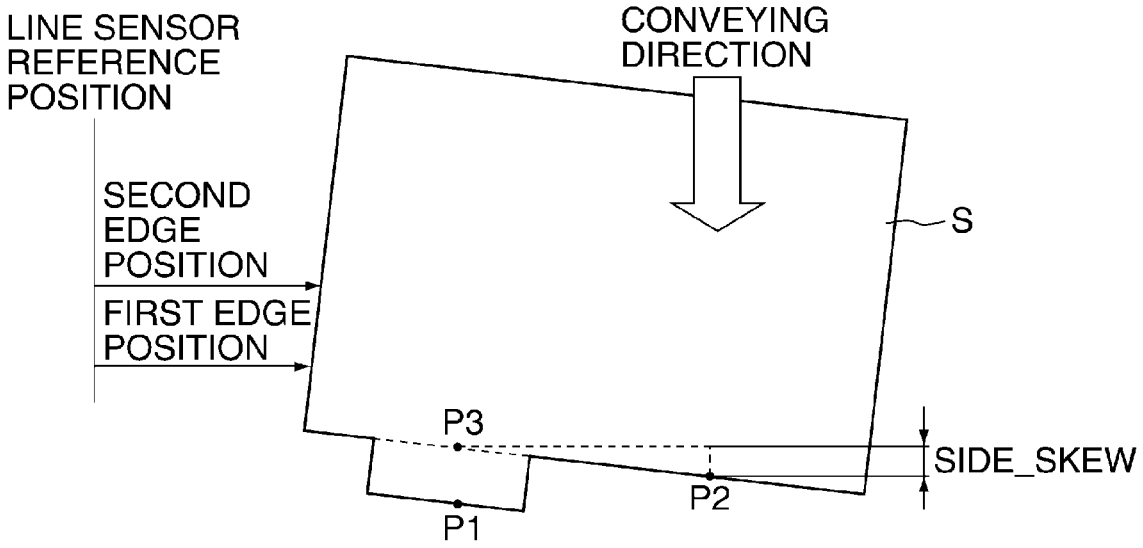
FIG. 7A is a view showing a state where a tabbed sheet is skewed so that a tab side thereof is delayed.

On the other hand, when the sheet S is skewed so that a tabbed side is delayed as show in FIG. 7A, the sensor 10 does not detect an imaginary leading edge P3 on the delay side when the sheet S is taken as a rectangular sheet, but detects a leading edge P1 of the tab. In this case, the leading edge registration detection signal adjustment unit 15 compares skew direction information (leading edge detection skew direction) from the leading edge skew calculation unit 17 and the skew direction information in the leading edge registration detection signal adjustment unit 15, and determines that the sheet S is in the state in FIG. 7A when these pieces of information are different from each other. The leading edge registration detection signal adjustment unit 15 delays a detection signal of P2 by a time T_Side_Skew calculated by dividing Side_Skew described above detected by the line sensor 8 by the conveying speed of the sheet S. Thus, the leading edge registration detection signal can be transmitted to the leading edge registration correction control unit 16 at the same timing as when the imaginary leading edge P3 is actually detected by the sensor 10. It should be noted that a skew direction is as shown in FIG. 7A when a difference obtained by subtracting the distance to the second edge position from the distance to the first edge position is plus. On the other hand, when the difference is minus, the skew state is as shown in FIG. 8A.

Figure 8B:
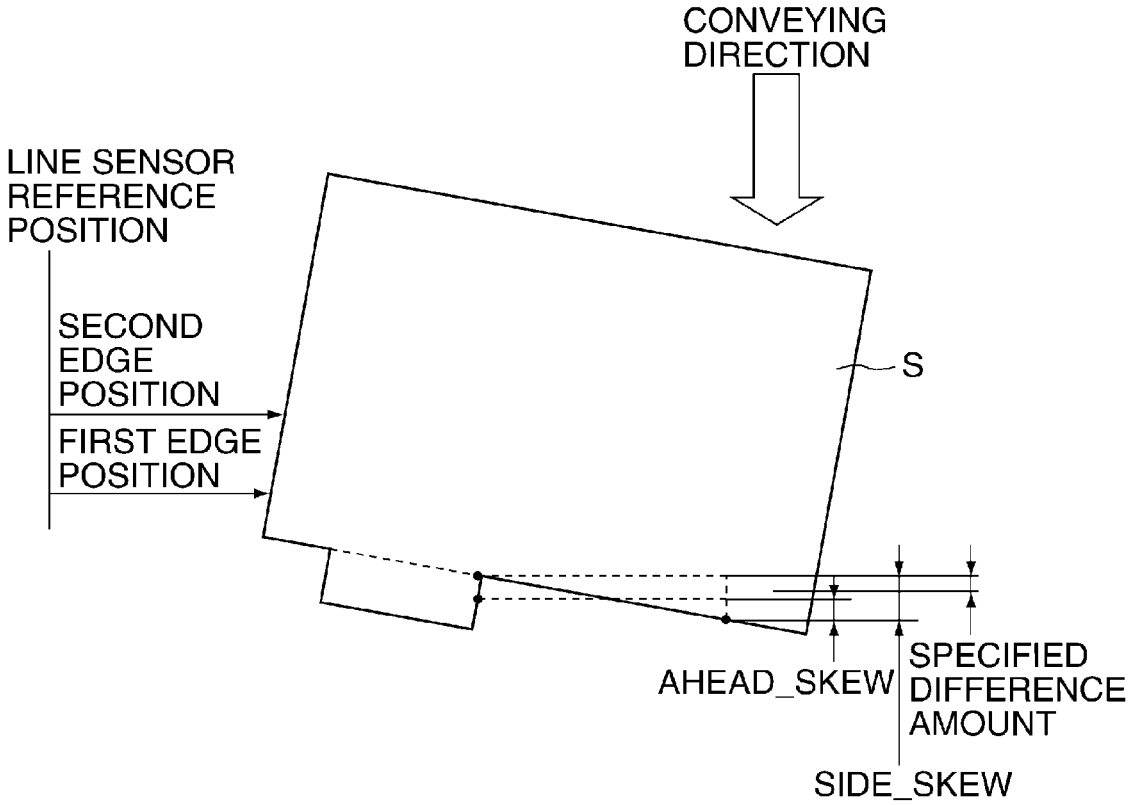
FIG. 8B is a view showing a state where P1 and P3 are apart from each other when the sensor detects an edge of the tab.
Figure 9:
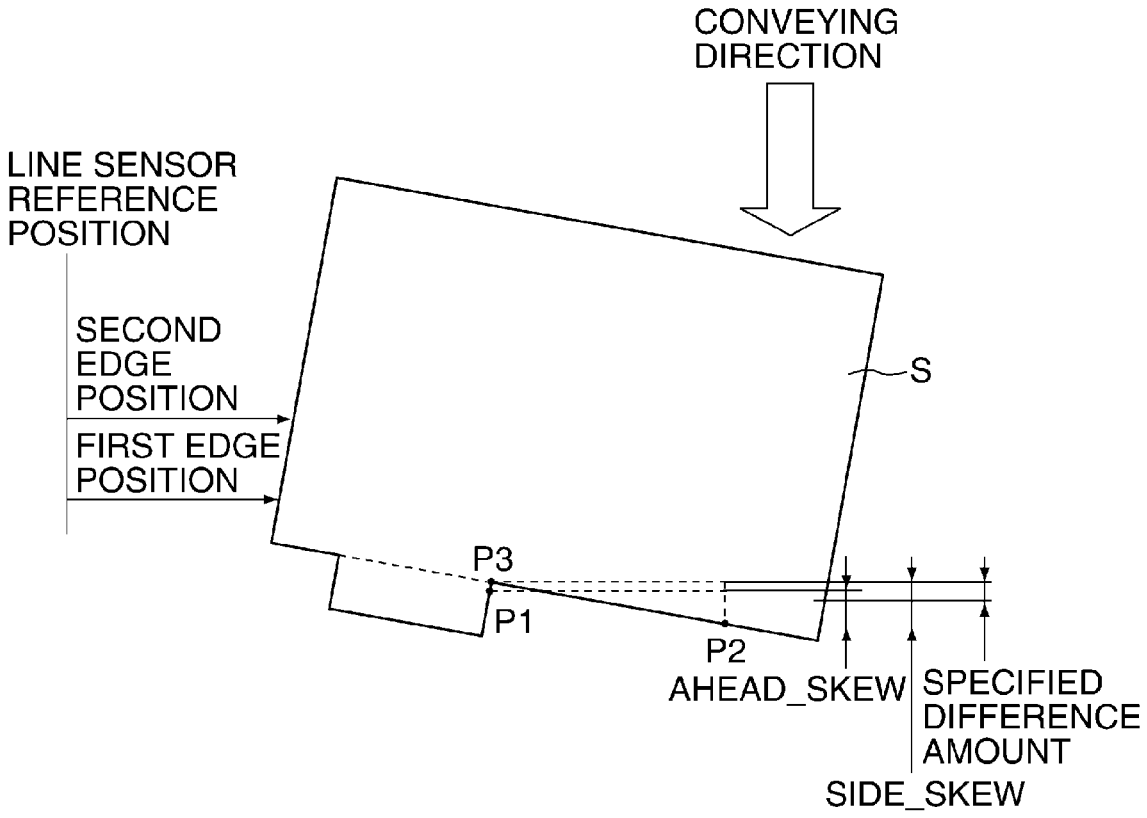
FIG. 9 is a view showing a state where P1 and P3 are close to each other when the sensor detects the edge of the tab.

As shown in FIGS. 8B and 9, when the sensor 10 detects an edge of the tab rather than the leading edge of the tab, the leading edge skew and the side skew are in the same direction, and these states cannot be narrowed down by a method of determining the skew state shown in FIG. 7A. In this case, the leading edge registration detection signal adjustment unit 15 compares Ahead_Skew and T_Side_Skew, and in view of a difference therebetween, outputs a leading edge registration detection signal. For example, as shown in FIG. 8B, when a value obtained by subtracting Ahead_Skew from Side_Skew is a specified difference amount or more, the leading edge registration detection signal adjustment unit 15 delays the detection signal of P2 by T_Side_Skew from a detection time of P2 on a preceding detection side. Thus, the leading edge registration detection signal can be transmitted to the leading edge registration correction control unit 16 at the same timing as when the imaginary leading edge P3 is actually detected by the sensor 10.

Also, as show in FIG. 9, when the value obtained by subtracting Ahead_Skew from Side_Skew is less than the specified difference amount, P1 and P3 are regarded to be substantially the same position, and a signal that detects P1 is output as the leading edge registration detection signal without change.

Next, a control flow of the image forming apparatus for implementing the method of adjusting the leading edge registration detection signal will be described with reference to FIGS. 10A and 10B.

Figure 10A:
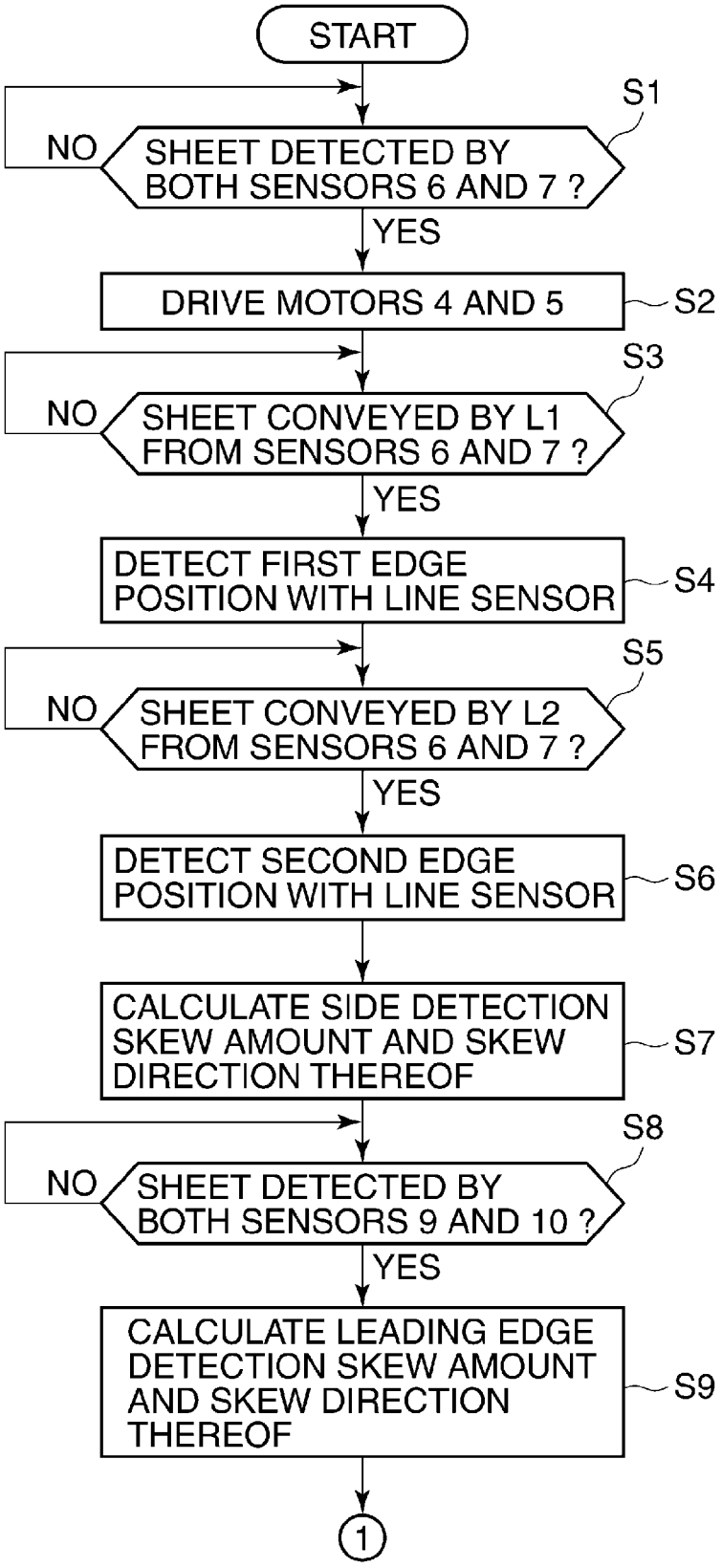
FIG. 10A is a flowchart showing a procedure of an adjustment process of a leading edge registration detection signal.
Figure 10B:
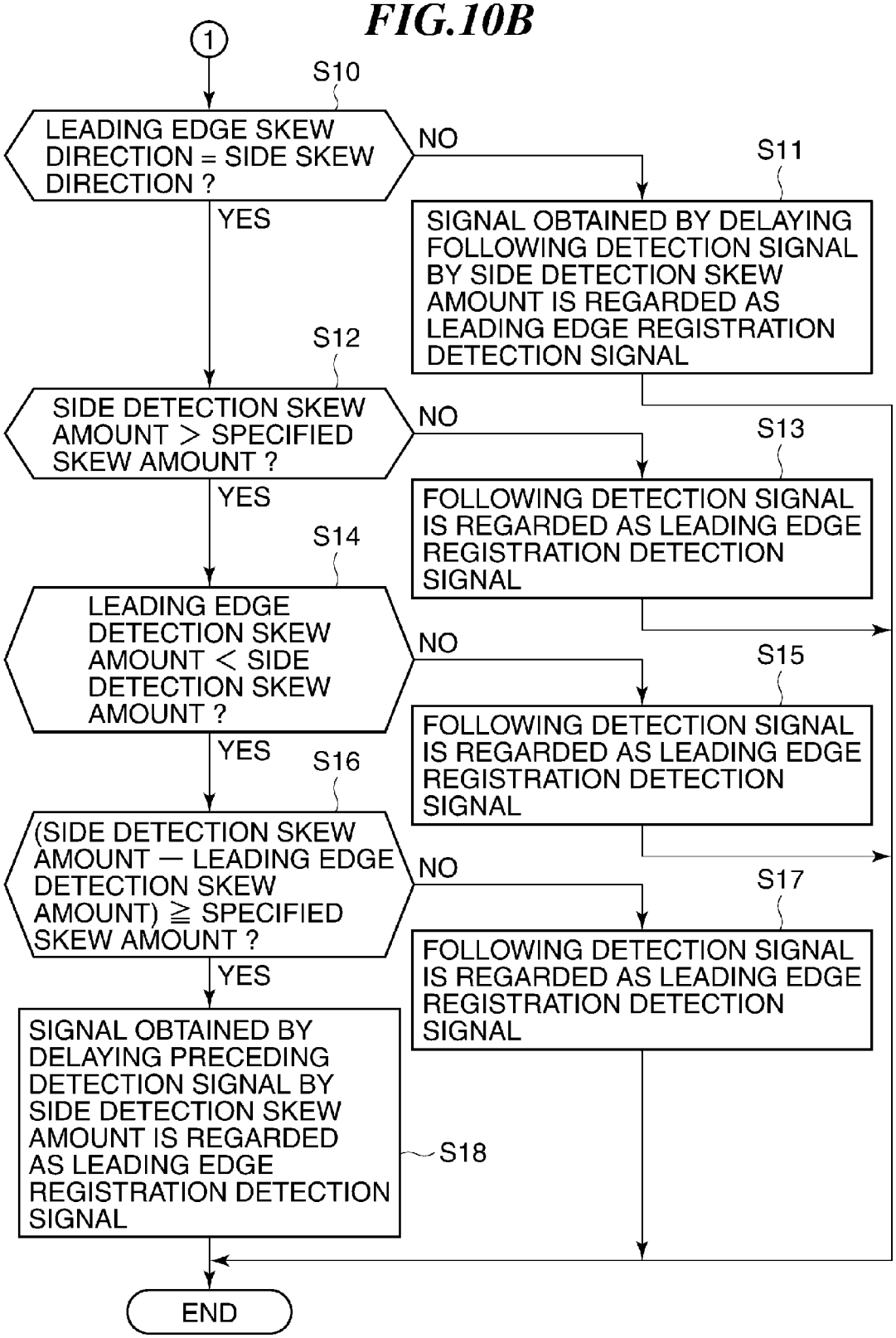
FIG. 10B is a flowchart following the flowchart in FIG. 10A.

FIGS. 10A and 10B are flowcharts showing a procedure of an adjustment process of the leading edge registration detection signal. This process is executed by the registration correction control unit 116 (hereinafter referred to as the control unit 116) shown in FIG. 2, more specifically, by blocks that constitute the control unit 116.

When the sheet S is conveyed from upstream of the conveying path, the control unit 116 determines whether both of the sensors 6 and 7 detect the leading edge of the sheet S, for example, as show in FIG. 3A (step S1). When both of the sensors 6 and 7 detect the sheet S and each detection signal is input to the control unit 116, the control unit 116 drives the motors 4 and 5 and starts rotation of the skew correction rollers 2 and 3 (step S2). Thus, the sheet S is conveyed downstream of the conveying path by the skew correction rollers 2 and 3.

Then, the control unit 16 determines whether the sheet S is conveyed to the position at the distance L1 from the sensors 6 and 7 as shown in FIG. 3B (step S3). When the sheet S is conveyed to the position at the distance L1, the control unit 116 detects a side edge position of the sheet S as a first edge position with the line sensor 8 (step S4). Then, the control unit 116 determines whether the sheet S is conveyed to the position at the distance L2 from the sensors 6 and 7 as shown in FIG. 5A (step S5). When the sheet S is conveyed to the position at the distance L2, the control unit 116 detects the side edge position of the sheet S as a second edge position with the line sensor 8 (step S6). The control unit 116 calculates a side detection skew amount and a skew direction based on the detected first edge position and second edge position by the above-described calculation, and stores the results in an unshown memory (step S7).

Then, the control unit 116 determines whether both of the sensors 9 and 10 detect the leading edge of the sheet S (step S8). When both of the sensors 9 and 10 detect the sheet S, the control unit 116 calculates a leading edge detection skew amount (including a skew direction) of the sheet S based on a difference between timing when the sensor 9 detects the sheet S and timing when the sensor 10 detects the sheet S (step S9).

In FIG. 10B, the control unit 116 determines whether the leading edge skew direction is the same as the side skew direction based on information on the leading edge detection skew amount (and skew direction) detected by the sensors 9 and 10 and the side detection skew amount (and skew direction) detected by the line sensor 8 (step S10).

When the leading edge skew direction is different from the side skew direction, the control unit 116 delays the detection signal (following detection signal) on the delay side detected by one among the sensors 9 and 10 by the side detection skew amount (Side_Skew) (step S11). The delayed detection signal is stored as the leading edge registration detection signal (step S11). This corresponds to a state of estimating the position P3 based on the position P2 in FIG. 7A.

Figure 7B:
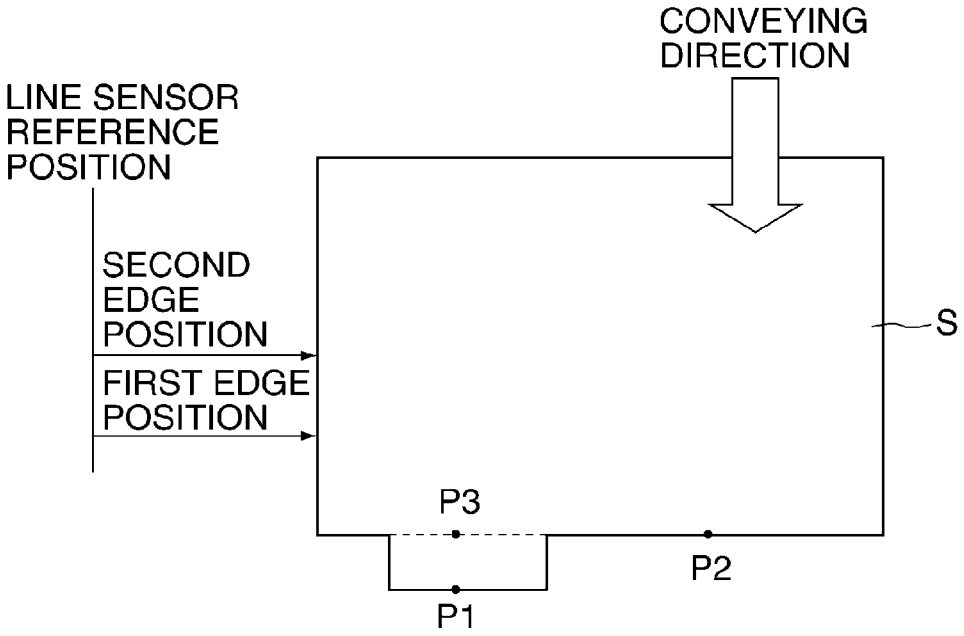
FIG. 7B is a view showing a state where the tabbed sheet is not skewed.

On the other hand, when the leading edge skew direction is the same as the side skew direction in step S10, the control unit 116 determines whether the side detection skew amount is larger than a specified skew amount (step S12). The specified skew amount is an acceptable minute skew amount that does not require skew correction. When the side skew detection amount is the acceptable skew amount or less, the control unit 116 determines that the skew state of the sheet S is acceptable, and regards the position P2 as the position P3 when the sheet S is taken as a rectangular sheet (FIG. 7B). In this case, the control unit 116 stores the following detection signal as the leading edge registration detection signal without change (step S13).

On the other hand, in step S12, when the side skew detection amount is larger than the specified skew amount, the control unit 116 compares the leading edge detection skew amount and the side detection skew amount (step S14).

In the case where the leading edge detection skew amount is the side detection skew amount or more (No in step S14), as shown in FIG. 8A, the position P2 is on the delay side compared to the position P3 when the sheet is taken as a rectangular sheet, and the following detection signal is stored as the leading edge registration detection signal without change (step S15).

On the other hand, when the leading edge detection skew amount is smaller than the side detection skew amount in step S14 (YES in step S14), the control unit 116 determines whether a value obtained by subtracting the leading edge detection skew amount from the side detection skew amount is the specified skew amount or more (step S16). The state when the leading edge detection skew amount is smaller than the side detection skew amount, and the difference therebetween is smaller than the specified skew amount (acceptable skew amount) (NO in step S16), can be exemplified the state shown in FIG. 9. In this case, the control unit 116 determines that the position P1 is substantially the same as the position P3, and the following detection signal detected at the position P1 is stored as the leading edge registration detection signal (step S17).

On the other hand, the state when the leading edge detection skew amount is smaller than the side detection skew amount, and the difference therebetween is the acceptable skew amount or more (YES in step S16) can be exemplified the state shown in FIG. 8B. In this case, the position P1 cannot be handled as the same position as the position P3. Specifically, since the position P3 is a position such that a preceding detection signal that detects P2 as a preceding detection position is delayed by a side skew amount, the control unit 116 delays the preceding detection signal by the side detection skew amount (Side_Skew), and stores the delayed signal as the leading edge registration detection signal (step S18). The stored leading edge registration detection signal is used for adjusting the conveying speed of the sheet by the registration roller pair 11 in order to synchronize the toner image with the sheet. Specifically, the control unit 116 controls the speed of the registration roller pair 11 based on the stored leading edge registration detection signal so that the sheet reaches a transfer position at predetermined transfer timing. It should be noted that the control unit 116 controls the speed so that the conveying speed of the sheet matches the conveying speed of the intermediate transfer belt 106 before the sheet reaches the transfer position.

According to the above descriptions, even if the tabbed sheet is in the skew state, the information on the side skew amount and direction and the leading edge skew amount and direction can be used to precisely determine the leading edge position on the delay side when the tabbed sheet is taken as a rectangular sheet. Thus, the leading edge registration correction of the sheet for transfer precisely aligns the position of the toner image with the position of the sheet S.

According to the embodiment, the leading edge of the tabbed sheet after the skew correction can be precisely predicted before the skew correction of the sheet is completed, and this can eliminate the need to increase the intervals between the registration roller pair 11 and the skew correction rollers 2 and 3 and can reduce a size of the image forming apparatus.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-030480, filed Feb. 15, 2010, and Japanese Patent Application No. 2011-025888, filed Feb. 9, 2011, which are hereby incorporated by reference herein in its entirety.

What is claimed is:

1. An image forming apparatus comprising:

a first conveying unit configured to convey a sheet;

a first skew detection unit configured to detect a skew amount of a side edge of the sheet conveyed by said first conveying unit and a skew direction thereof;

a second skew detection unit configured to detect a skew amount of a leading edge of the sheet conveyed by said first conveying unit and a skew direction thereof;

a skew correction unit configured to correct skew of the sheet based on a detection result of said first skew detection unit;

a second conveying unit configured to convey the sheet the skew of which has been corrected by said skew correction unit;

a transfer unit configured to transfer a toner image to the sheet the skew of which has been corrected;

a leading edge position determination unit configured to preliminarily determine, before the skew correction by said skew correction unit is completed, a leading edge position of the sheet with the skew thereof corrected by said skew correction unit, based on the detection result of said first skew detection unit and a detection result of said second skew detection unit, and a control unit configured to control said second conveying unit so that the toner image is transferred on a predetermined position of the sheet conveyed by said second conveying unit based on a determination result of said leading edge position determination unit.

2. An image forming apparatus according to claim 1, wherein said second skew detection unit having first and second sensors for detecting the sheet provided on a direction perpendicular to a conveying direction of the sheet, wherein the skew amount is detected based on a difference in timing of sheet detection by the first and second sensors.

3. The image forming apparatus according to claim 1, wherein said skew correction unit includes a pair of first rollers and a pair of second rollers provided along the direction perpendicular to the conveying direction of the sheet, and is configured to correct skew of the sheet by reducing a speed of the pair of rollers on a sheet corner side that precedes by the skew of the sheet.

4. The image forming apparatus according to claim 2, wherein when the sheet is in a first state that the skew direction detected by said first skew detection unit is different from the skew direction detected by said second skew detection unit, said leading edge position determination unit determines the leading edge position based on a detection signal of one of the first and second sensors that detects the sheet later than the other one thereof, and the skew amount detected by said first skew detection unit.

5. The image forming apparatus according to claim 4, wherein when the sheet is in the first state, said leading edge position determination unit regards a signal obtained by delaying the detection signal of one of the first and second sensors, that detects the sheet later than the other one thereof, by a time according to the skew amount detected by said first skew detection unit, as a signal representing the leading edge position.

6. The image forming apparatus according to claim 2, wherein when the sheet is in a second state that the skew direction detected by said first skew detection unit is the same as the skew direction detected by said second skew detection unit, and the skew amount detected by said first skew detection unit is a predetermined amount or less, said leading edge position determination unit determines the leading edge position based on the detection signal of one of the first and second sensors that detects the sheet later than the other one thereof.

7. The image forming apparatus according to claim 6, wherein when the sheet is in the second state, said leading edge position determination unit regards the detection signal of the one of the first and second sensors, that detects the sheet later than the other one thereof, as the signal representing the leading edge position.

8. The image forming apparatus according to claim 2, wherein when the sheet is in a third state that the skew direction detected by said first skew detection unit is the same as the skew direction detected by said second skew detection unit, and the skew amount detected by said first skew detection unit is larger than a predetermined amount and the skew amount detected by said second skew detection unit is equal to or larger than the skew amount detected by said first skew detection unit, said leading edge position determination unit determines the leading edge position based on the detection signal of one of the first and second sensors that detects the sheet later than the other one thereof.

9. The image forming apparatus according to claim 8, wherein when the sheet is in the third state, said leading edge position determination unit regards the detection signal of the one of the first and second sensors, that detects the sheet later than the other one thereof, as the signal representing the leading edge position.

10. The image forming apparatus according to claim 2, wherein when the sheet is in a fourth state that the skew direction detected by said first skew detection unit is the same as the skew direction detected by said second skew detection unit, the skew amount detected by said first skew detection unit is larger than a predetermined amount, the skew amount detected by said first skew detection unit is larger than the skew amount detected by said second skew detection unit, and a value obtained by subtracting the skew amount detected by said second skew detection unit from the skew amount detected by said first skew detection unit is the predetermined amount or more, said leading edge position determination unit determines the leading edge position based on the detection signal of one of the first and second sensors that detects the sheet later than the other one thereof.

11. The image forming apparatus according to claim 10, wherein when the sheet is in the fourth state, said leading edge position determination unit regards the detection signal of the one of the first and second sensors, that detects the sheet later than the other one thereof, as the signal representing the leading edge position.

12. The image forming apparatus according to claim 2, wherein when the sheet is in a fifth state that the skew direction detected by said first skew detection unit is the same as the skew direction detected by said second skew detection unit, the skew amount detected by said first skew detection unit is larger than a predetermined amount, the skew amount detected by said first skew detection unit is larger than the skew amount detected by said second skew detection unit, and a value obtained by subtracting the skew amount detected by said second skew detection unit from the skew amount detected by said first skew detection unit is smaller than the predetermined amount, said leading edge position determination unit determines the leading edge position based on a detection signal of one of the first and second sensors that detects the sheet earlier than the other one thereof, and the skew amount detected by said first skew detection unit.

13. The image forming apparatus according to claim 12, wherein when the sheet is in the fifth state, said leading edge position determination unit regards a signal obtained by delaying the detection signal of the one of the first and second sensors, that detects the sheet earlier than the other one thereof, by a time according to the skew amount detected by said first skew detection unit, as the signal representing the leading edge position.

14. A control method for an image forming apparatus comprising:

a conveying step of conveying a sheet with a first conveying unit;

a first skew detection step of detecting a skew amount of a side edge of the sheet conveyed in said conveying step and a skew direction thereof;

a second skew detection step of detecting a skew amount of a leading edge of the sheet conveyed in said conveying step and a skew direction thereof;

a skew correction step of correcting skew of the sheet based on a detection result in said first skew detection step;

a second conveying step to convey the sheet the skew of which has been corrected by said skew correction step with a second conveying unit;

a transfer step of transferring a toner image to the sheet the skew of which has been corrected with a transfer unit;

a leading edge position determination step to preliminarily determine, before the skew correction in said skew correction step is completed, a leading edge position of the sheet with the skew thereof corrected in said skew correction step, based on the detection result of said first skew detection step and a detection result of said second skew detection step, and a control step of conveying the sheet in said second conveying step so that the toner image is transferred on a predetermined position of the sheet based on a determination result in said leading edge position determination step.

15. A computer-readable non-transitory storage medium storing a program for causing a computer to execute a control method for an image forming apparatus, the control method comprising:

a conveying step of conveying a sheet with a first conveying unit;

a first skew detection step of detecting a skew amount of a side edge of the sheet conveyed in said conveying step and a skew direction thereof;

a second skew detection step of detecting a skew amount of a leading edge of the sheet conveyed in said conveying step and a skew direction thereof;

a skew correction step of correcting skew of the sheet based on a detection result in said first skew detection step;

a second conveying step to convey the sheet the skew of which has been corrected by said skew correction step with a second conveying unit;

a transfer step of transferring a toner image to the sheet the skew of which has been corrected with a transfer unit;

a leading edge position determination step to preliminarily determine, before the skew correction in said skew correction step is completed, a leading edge position of the sheet with the skew thereof corrected in said skew correction step, based on the detection result of said first skew detection step and a detection result of said second skew detection step, and a conveying control step of conveying the sheet in said second conveying step so that the toner image is transferred on a predetermined position of the sheet based on a determination result in said leading edge position determination.

16. An image forming apparatus comprising:

a first conveying unit configured to convey a sheet;

a first skew detection unit configured to detect a skew amount of a side edge of the sheet conveyed by said first conveying unit and a skew direction thereof;

a second skew detection unit configured to detect a skew amount of a leading edge of the sheet conveyed by said first conveying unit and a skew direction thereof;

a skew correction unit configured to correct skew of the sheet based on a detection result of said first skew detection unit;

a second conveying unit configured to convey the sheet the skew of which has been corrected by said skew correction unit;

a transfer unit configured to transfer a toner image to the sheet conveyed by said second conveying unit; and a control unit configured to control said second conveying unit so that the toner image is transferred on a predetermined position of the sheet conveyed by said second conveying unit based on the detection result of said first skew detection unit and a detection result of said second skew detection unit, wherein said second skew detection unit has first and second sensors for detecting the sheet provided on a direction perpendicular to a conveying direction of the sheet, and detects the skew amount based on a difference in timing of sheet detection by the first and second sensors, wherein said control unit predicts a position of the leading edge of the sheet with the skew thereof corrected based on the detection results of the first and second sensors, and controls said second conveying unit based on the predicted position of the leading edge, and wherein when the sheet is in a first state that the skew direction detected by said first skew detection unit is different from the skew direction detected by said second skew detection unit, said control unit determines the leading edge position based on a detection signal of one of the first and second sensors that detects the sheet later than the other one thereof, and the skew amount detected by said first skew detection unit.

17. The image forming apparatus according to claim 16, wherein said control unit controls a speed of said second conveying unit so that the toner image is transferred on the predetermined position of the sheet.

18. The image forming apparatus according to claim 16, wherein said skew correction unit includes a pair of first rollers and a pair of second rollers provided along the direction perpendicular to the conveying direction of the sheet, and the first and second sensors are placed on a downstream side of the pair of first rollers and the pair of second rollers in the conveying direction, and on an upstream side of said second conveying unit in the conveying direction.

19. The image forming apparatus according to claim 18, wherein said skew correction unit corrects skew of the sheet by reducing a speed of the pair of rollers on a sheet corner side that proceeds by the skew of the sheet.

20. The image forming apparatus according to claim 16, wherein said first skew detection unit has a sensor in the form of an array for detecting a position of the side edge of the sheet in the direction perpendicular to the conveying direction, and detects the skew amount based on a position of the side edge having been detected at a first timing and a position of the side edge having been detected at a second timing.

21. The image forming apparatus according to claim 16, wherein when the sheet is in the first state, said control unit regards a signal obtained by delaying the detection signal of one of the first and second sensors, that detects the sheet later than the other one thereof, by a time according to the skew amount detected by said first skew detection unit, as a signal representing the leading edge position.

22. An image forming apparatus comprising:

a first conveying unit configured to convey a sheet;

a first skew detection unit configured to detect a skew amount of a side edge of the sheet conveyed by said first conveying unit and a skew direction thereof;

a second skew detection unit configured to detect a skew amount of a leading edge of the sheet conveyed by said first conveying unit and a skew direction thereof;

a skew correction unit configured to correct skew of the sheet based on a detection result of said first skew detection unit;

a second conveying unit configured to convey the sheet the skew of which has been corrected by said skew correction unit;

a transfer unit configured to transfer a toner image to the sheet conveyed by said second conveying unit; and a control unit configured to control said second conveying unit so that the toner image is transferred on a predetermined position of the sheet conveyed by said second conveying unit based on the detection result of said first skew detection unit and a detection result of said second skew detection unit, wherein said second skew detection unit has first and second sensors for detecting the sheet provided on a direction perpendicular to a conveying direction of the sheet, and detects the skew amount based on a difference in timing of sheet detection by the first and second sensors, wherein said control unit predicts a position of the leading edge of the sheet with the skew thereof corrected based on the detection results of the first and second sensors, and controls said second conveying unit based on the predicted position of the leading edge, and wherein when the sheet is in a second state that the skew direction detected by said first skew detection unit is the same as the skew direction detected by said second skew detection unit, and the skew amount detected by said first skew detection unit is a predetermined amount or less, said control unit determines the leading edge position based on the detection signal of one of the first and second sensors that detects the sheet later than the other one thereof.

23. The image forming apparatus according to claim 22, wherein when the sheet is in the second state, said control unit regards the detection signal of the one of the first and second sensors, that detects the sheet later than the other one thereof, as the signal representing the leading edge position.

24. An image forming apparatus comprising:

a first conveying unit configured to convey a sheet;

a first skew detection unit configured to detect a skew amount of a side edge of the sheet conveyed by said first conveying unit and a skew direction thereof;

a second skew detection unit configured to detect a skew amount of a leading edge of the sheet conveyed by said first conveying unit and a skew direction thereof;

a skew correction unit configured to correct skew of the sheet based on a detection result of said first skew detection unit;

a second conveying unit configured to convey the sheet the skew of which has been corrected by said skew correction unit;

a transfer unit configured to transfer a toner image to the sheet conveyed by said second conveying unit; and a control unit configured to control said second conveying unit so that the toner image is transferred on a predetermined position of the sheet conveyed by said second conveying unit based on the detection result of said first skew detection unit and a detection result of said second skew detection unit, wherein said second skew detection unit has first and second sensors for detecting the sheet provided on a direction perpendicular to a conveying direction of the sheet, and detects the skew amount based on a difference in timing of sheet detection by the first and second sensors, wherein said control unit predicts a position of the leading edge of the sheet with the skew thereof corrected based on the detection results of the first and second sensors, and controls said second conveying unit based on the predicted position of the leading edge, and wherein when the sheet is in a third state that the skew direction detected by said first skew detection unit is the same as the skew direction detected by said second skew detection unit, and the skew amount detected by said first skew detection unit is larger than a predetermined amount and the skew amount detected by said second skew detection unit is equal to or larger than the skew amount detected by said first skew detection unit, said control unit determines the leading edge position based on the detection signal of one of the first and second sensors that detects the sheet later than the other one thereof.

25. The image forming apparatus according to claim 24, wherein when the sheet is in the third state, said control unit regards the detection signal of the one of the first and second sensors, that detects the sheet later than the other one thereof, as the signal representing the leading edge position.

26. An image forming apparatus comprising:

a first conveying unit configured to convey a sheet;

a first skew detection unit configured to detect a skew amount of a side edge of the sheet conveyed by said first conveying unit and a skew direction thereof;

a second skew detection unit configured to detect a skew amount of a leading edge of the sheet conveyed by said first conveying unit and a skew direction thereof;

a skew correction unit configured to correct skew of the sheet based on a detection result of said first skew detection unit;

a second conveying unit configured to convey the sheet the skew of which has been corrected by said skew correction unit;

a transfer unit configured to transfer a toner image to the sheet conveyed by said second conveying unit; and a control unit configured to control said second conveying unit so that the toner image is transferred on a predetermined position of the sheet conveyed by said second conveying unit based on the detection result of said first skew detection unit and a detection result of said second skew detection unit, wherein said second skew detection unit has first and second sensors for detecting the sheet provided on a direction perpendicular to a conveying direction of the sheet, and detects the skew amount based on a difference in timing of sheet detection by the first and second sensors, wherein said control unit predicts a position of the leading edge of the sheet with the skew thereof corrected based on the detection results of the first and second sensors, and controls said second conveying unit based on the predicted position of the leading edge, and wherein when the sheet is in a fourth state that the skew direction detected by said first skew detection unit is the same as the skew direction detected by said second skew detection unit, the skew amount detected by said first skew detection unit is larger than a predetermined amount, the skew amount detected by said first skew detection unit is larger than the skew amount detected by said second skew detection unit, and a value obtained by subtracting the skew amount detected by said second skew detection unit from the skew amount detected by said first skew detection unit is the predetermined amount or more, said control unit determines the leading edge position based on the detection signal of one of the first and second sensors that detects the sheet later than the other one thereof.

27. The image forming apparatus according to claim 26, wherein when the sheet is in the fourth state, said control unit regards the detection signal of the one of the first and second sensors, that detects the sheet later than the other one thereof, as the signal representing the leading edge position.

28. An image forming apparatus comprising:

a first conveying unit configured to convey a sheet;

a first skew detection unit configured to detect a skew amount of a side edge of the sheet conveyed by said first conveying unit and a skew direction thereof;

a second skew detection unit configured to detect a skew amount of a leading edge of the sheet conveyed by said first conveying unit and a skew direction thereof;

a skew correction unit configured to correct skew of the sheet based on a detection result of said first skew detection unit;

a second conveying unit configured to convey the sheet the skew of which has been corrected by said skew correction unit;

a transfer unit configured to transfer a toner image to the sheet conveyed by said second conveying unit; and a control unit configured to control said second conveying unit so that the toner image is transferred on a predetermined position of the sheet conveyed by said second conveying unit based on the detection result of said first skew detection unit and a detection result of said second skew detection unit, wherein said second skew detection unit has first and second sensors for detecting the sheet provided on a direction perpendicular to a conveying direction of the sheet, and detects the skew amount based on a difference in timing of sheet detection by the first and second sensors, wherein said control unit predicts a position of the leading edge of the sheet with the skew thereof corrected based on the detection results of the first and second sensors, and controls said second conveying unit based on the predicted position of the leading edge, and wherein when the sheet is in a fifth state that the skew direction detected by said first skew detection unit is the same as the skew direction detected by said second skew detection unit, the skew amount detected by said first skew detection unit is larger than a predetermined amount, the skew amount detected by said first skew detection unit is larger than the skew amount detected by said second skew detection unit, and a value obtained by subtracting the skew amount detected by said second skew detection unit from the skew amount detected by said first skew detection unit is smaller than the predetermined amount, said control unit determines the leading edge position based on a detection signal of one of the first and second sensors that detects the sheet earlier than the other one thereof, and the skew amount detected by said first skew detection unit.

29. The image forming apparatus according to claim 28, wherein when the sheet is in the fifth state, said control unit regards a signal obtained by delaying the detection signal of the one of the first and second sensors, that detects the sheet earlier than the other one thereof, by a time according to the skew amount detected by said first skew detection unit, as the signal representing the leading edge position.

30. The image forming apparatus according to claim 22, wherein said control unit controls a speed of said second conveying unit so that the toner image is transferred on the predetermined position of the sheet.

31. The image forming apparatus according to claim 24, wherein said control unit controls a speed of said second conveying unit so that the toner image is transferred on the predetermined position of the sheet.

32. The image forming apparatus according to claim 26, wherein said control unit controls a speed of said second conveying unit so that the toner image is transferred on the predetermined position of the sheet.

33. The image forming apparatus according to claim 28, wherein said control unit controls a speed of said second conveying unit so that the toner image is transferred on the predetermined position of the sheet.

34. The image forming apparatus according to claim 22, wherein said skew correction unit includes a pair of first rollers and a pair of second rollers provided along the direction perpendicular to the conveying direction of the sheet, and the first and second sensors are placed on a downstream side of the pair of first rollers and the pair of second rollers in the conveying direction, and on an upstream side of said second conveying unit in the conveying direction.

35. The image forming apparatus according to claim 24, wherein said skew correction unit includes a pair of first rollers and a pair of second rollers provided along the direction perpendicular to the conveying direction of the sheet, and the first and second sensors are placed on a downstream side of the pair of first rollers and the pair of second rollers in the conveying direction, and on an upstream side of said second conveying unit in the conveying direction.

36. The image forming apparatus according to claim 26, wherein said skew correction unit includes a pair of first rollers and a pair of second rollers provided along the direction perpendicular to the conveying direction of the sheet, and the first and second sensors are placed on a downstream side of the pair of first rollers and the pair of second rollers in the conveying direction, and on an upstream side of said second conveying unit in the conveying direction.

37. The image forming apparatus according to claim 28, wherein said skew correction unit includes a pair of first rollers and a pair of second rollers provided along the direction perpendicular to the conveying direction of the sheet, and the first and second sensors are placed on a downstream side of the pair of first rollers and the pair of second rollers in the conveying direction, and on an upstream side of said second conveying unit in the conveying direction.

38. The image forming apparatus according to claim 22, wherein said skew correction unit corrects skew of the sheet by reducing a speed of the pair of rollers on a sheet corner side that proceeds by the skew of the sheet.

39. The image forming apparatus according to claim 24, wherein said skew correction unit corrects skew of the sheet by reducing a speed of the pair of rollers on a sheet corner side that proceeds by the skew of the sheet.

40. The image forming apparatus according to claim 26, wherein said skew correction unit corrects skew of the sheet by reducing a speed of the pair of rollers on a sheet corner side that proceeds by the skew of the sheet.

41. The image forming apparatus according to claim 28, wherein said skew correction unit corrects skew of the sheet by reducing a speed of the pair of rollers on a sheet corner side that proceeds by the skew of the sheet.

42. The image forming apparatus according to claim 22, wherein said first skew detection unit has a sensor in the form of an array for detecting a position of the side edge of the sheet in the direction perpendicular to the conveying direction, and detects the skew amount based on a position of the side edge having been detected at a first timing and a position of the side edge having been detected at a second timing.

43. The image forming apparatus according to claim 24, wherein said first skew detection unit has a sensor in the form of an array for detecting a position of the side edge of the sheet in the direction perpendicular to the conveying direction, and detects the skew amount based on a position of the side edge having been detected at a first timing and a position of the side edge having been detected at a second timing.

44. The image forming apparatus according to claim 26, wherein said first skew detection unit has a sensor in the form of an array for detecting a position of the side edge of the sheet in the direction perpendicular to the conveying direction, and detects the skew amount based on a position of the side edge having been detected at a first timing and a position of the side edge having been detected at a second timing.

45. The image forming apparatus according to claim 28, wherein said first skew detection unit has a sensor in the form of an array for detecting a position of the side edge of the sheet in the direction perpendicular to the conveying direction, and detects the skew amount based on a position of the side edge having been detected at a first timing and a position of the side edge having been detected at a second timing.

* * * * *